US008661869B2

(12) United States Patent
Polen et al.

(10) Patent No.: US 8,661,869 B2
(45) Date of Patent: Mar. 4, 2014

(54) STRETCH FORMING APPARATUS WITH SUPPLEMENTAL HEATING AND METHOD

(75) Inventors: Larry Alexander Polen, Matthews, NC (US); Thomas Sandy Houston, Charlotte, NC (US); John E. Owens, Jr., Charlotte, NC (US)

(73) Assignee: Cyril Bath Company, Monroe, NC (US)

( * ) Notice: Subject to any disclaimer, the term of this patent is extended or adjusted under 35 U.S.C. 154(b) by 846 days.

(21) Appl. No.: 12/627,837

(22) Filed: Nov. 30, 2009

(65) Prior Publication Data

US 2010/0071430 A1 Mar. 25, 2010

Related U.S. Application Data

(63) Continuation-in-part of application No. 11/307,176, filed on Jan. 26, 2006, now Pat. No. 7,669,452.

(60) Provisional application No. 60/597,034, filed on Nov. 4, 2005.

(51) Int. Cl.
*B21D 11/02* (2006.01)

(52) U.S. Cl.
USPC ..... 72/302; 72/342.5; 72/342.96; 72/364; 72/392; 72/342.4

(58) Field of Classification Search
USPC ..... 72/302, 342, 342.1, 342.5, 342.6, 72/342.7, 392, 297, 342.92, 342.94, 72/342.96, 377, 378, 342.4, 364; 219/151, 219/153
See application file for complete search history.

(56) References Cited

U.S. PATENT DOCUMENTS

| | | | | |
|---|---|---|---|---|
| 2,633,522 | A * | 3/1953 | Berg et al. | 65/269 |
| 2,702,578 | A | 2/1955 | Hoffman | |
| 2,739,637 | A | 3/1956 | Tyler | |
| 2,944,500 | A | 7/1960 | Raynes | |
| 3,370,151 | A | 2/1968 | Normand | |
| 3,550,422 | A | 12/1970 | Potter | |
| 3,568,490 | A * | 3/1971 | Bohmann | 72/302 |
| 3,015,292 | A | 6/1971 | Bridwell | |
| 3,025,905 | A | 6/1971 | Haerr | |
| 3,584,487 | A | 6/1971 | Carlson | |
| RE27,155 | E * | 7/1971 | Hansen | 425/524 |
| 3,635,068 | A | 1/1972 | Watmough et al. | |
| 3,722,068 | A | 3/1973 | Manchester et al. | |

(Continued)

FOREIGN PATENT DOCUMENTS

| | | | |
|---|---|---|---|
| JP | U 64-010343 | A | 1/1989 |
| JP | 01129955 | A | 5/1989 |

(Continued)

OTHER PUBLICATIONS

Chinese Translation of the Decision of Rejection for Chinese Application No. 200680040245.0.

(Continued)

*Primary Examiner* — Shelley Self
*Assistant Examiner* — Homer Boyer
(74) *Attorney, Agent, or Firm* — Henry B. Ward, III

(57) ABSTRACT

A stretch-forming apparatus includes a main frame which carries a die enclosure between jaw assemblies. The die enclosure includes radiant heaters for supplying heat to a workpiece being stretch-formed against the die.

24 Claims, 12 Drawing Sheets

(56) References Cited

U.S. PATENT DOCUMENTS

| | | | | | |
|---|---|---|---|---|---|
| 3,823,303 | A | | 7/1974 | Manchester et al. | |
| 3,874,673 | A | * | 4/1975 | Beard | 473/262 |
| 3,922,134 | A | * | 11/1975 | Kupfrian | 425/292 |
| 3,933,020 | A | | 1/1976 | Orr et al. | |
| 3,965,715 | A | | 6/1976 | Parmann | |
| 3,979,815 | A | | 9/1976 | Nakanose et al. | |
| 4,011,429 | A | * | 3/1977 | Morris et al. | 219/153 |
| 4,145,908 | A | | 3/1979 | Miller | |
| 4,474,044 | A | * | 10/1984 | Leistner et al. | 72/19.1 |
| 4,625,533 | A | * | 12/1986 | Okada et al. | 72/302 |
| 4,815,308 | A | | 3/1989 | Moroney | |
| 4,827,753 | A | * | 5/1989 | Moroney | 72/296 |
| 4,888,973 | A | * | 12/1989 | Comley | 72/342.92 |
| 4,970,886 | A | | 11/1990 | Sikora et al. | |
| 4,984,348 | A | * | 1/1991 | Cadwell | 29/423 |
| 5,074,533 | A | * | 12/1991 | Frantz | 266/254 |
| 5,086,636 | A | | 2/1992 | Huet | |
| 5,113,681 | A | | 5/1992 | Guesnon et al. | |
| 5,127,885 | A | * | 7/1992 | Herbert et al. | 474/260 |
| 5,892,203 | A | * | 4/1999 | Jordan et al. | 219/393 |
| 6,071,360 | A | | 6/2000 | Gillespie | |
| 6,107,606 | A | * | 8/2000 | Hotchkiss | 219/411 |
| 6,147,565 | A | * | 11/2000 | Satoh et al. | 331/70 |
| 6,463,779 | B1 | | 10/2002 | Terziakin | |
| 6,544,357 | B1 | * | 4/2003 | Hehmann et al. | 148/420 |
| 6,550,124 | B2 | | 4/2003 | Krajewski et al. | |
| 6,619,861 | B2 | * | 9/2003 | Twist et al. | 396/635 |
| 6,679,091 | B2 | | 1/2004 | Yamada et al. | |
| 6,753,506 | B2 | * | 6/2004 | Liu et al. | 219/390 |
| 6,835,254 | B2 | * | 12/2004 | Hammar et al. | 148/564 |
| 6,897,407 | B2 | | 5/2005 | Gomez | |
| 2003/0217991 | A1 | | 11/2003 | Gomez | |
| 2005/0199031 | A1 | | 9/2005 | Hammar | |
| 2006/0240372 | A1 | | 10/2006 | Gertitschke | |
| 2007/0102493 | A1 | | 5/2007 | Polen et al. | |

FOREIGN PATENT DOCUMENTS

| | | | |
|---|---|---|---|
| JP | 03-108214 | A | 8/1991 |
| JP | U 04-110104 | A | 4/1992 |
| JP | U 11-290962 | A | 10/1999 |
| JP | 2002210529 | A | 7/2002 |
| RU | 2170771 | C2 | 7/2001 |

OTHER PUBLICATIONS

First Examination Report for Australian Application No. 20100200928 issued Feb. 2, 2011.

Japanese Patent Office; Office Action; Feb. 28, 2012; issued in Japanese Patent Application No. 2008-539155.

International Search Report for International Patent Application No. PCT/US2010/031985; Jun. 22, 2010.

International Preliminary Report on Patentability for International Patent Application No. PCT/US2010/031985; Jun. 14, 2012.

Examiner's first report issued in Australian Application No. 2006311323 on Aug. 4, 2009.

Japanese Patent Office; Final Office Action; Aug. 30, 2012; issued in Japanese Patent Application No. 2008-539155.

* cited by examiner

STRETCH FORMING APPARATUS WITH SUPPLEMENTAL HEATING AND METHOD

TECHNICAL FIELD AND BACKGROUND OF THE INVENTION

This invention relates to forming metallic components, and more specifically to hot stretch forming and creep forming of titanium and its alloys by application of supplemental heating during selected stages of the stretch-forming process.

Stretch forming is a well-known process used to form curved shapes in metallic components by pre-stretching a workpiece to its yield point while forming it over a die. This process is often used to make large aluminum and aluminum-alloy components, and has low tooling costs and excellent repeatability.

Titanium or titanium alloys are substituted for aluminum in certain components, especially those for aerospace applications. Reasons for doing so include titanium's higher strength-to weight ratio, higher ultimate strength, and better metallurgical compatibility with composite materials.

However, there are difficulties in stretch-forming titanium at ambient temperature because its yield point is very close to its ultimate tensile strength with a minimal percent elongation value. Therefore, titanium components are typically bump formed and machined from large billets, an expensive and time-consuming process. It is known to apply heat to titanium components during stretch-forming by electrically insulating the titanium component and then heating the component by passing current through the component, causing resistance heating. However, there are applications where this process is not sufficient to achieve the desired result.

Accordingly, there is a need for an apparatus and method for stretch-forming titanium and its alloys. It has been determined that application of radiant heat to the component by means of proximate resistance elements provides further enhancement to the titanium-forming process.

SUMMARY OF THE INVENTION

Accordingly, it is an object of the invention to provide a method for stretch forming and/or creep forming titanium at elevated temperatures.

It is another object of the invention to provide an apparatus for stretch forming and/or creep forming titanium at elevated temperatures.

It is another object of the invention to provide an apparatus for applying supplemental heat to a workpiece during a forming process.

These and other objects of the invention are achieved in a method of stretch-forming, comprising the steps of providing an elongated metallic workpiece having a preselected cross-sectional profile and a die having a working face complementary to the cross-sectional profile, wherein at least the working face comprises a thermally insulated material. The workpiece is resistance heated to a working temperature by passing electrical current therethrough, and the workpiece is formed against the working face by causing the workpiece and the die to move relative to each other while the workpiece is at the working temperature, thereby causing plastic elongation and bending of the workpiece and shaping the workpiece into a preselected final form. At one or more predetermined positions of the workpiece in relation to the die, radiant heat is applied to one or more predetermined portions of the workpiece to increase the plastic elongation of the workpiece at the one or more predetermined portions.

In accordance with another embodiment of the invention, the workpiece comprises titanium, and the step of applying radiant heat to the workpiece comprises the step of applying the radiant heat from a position wherein the heat is applied to a side of the workpiece opposite a working face-engaging side of the workpiece.

In accordance with another embodiment of the invention, the step of applying radiant heat to the workpiece comprises the step of applying the radiant heat from a position wherein the heat is applied to a side of the workpiece generally perpendicular to a working face-engaging side of the workpiece.

In accordance with another embodiment of the invention, the step of applying radiant heat to the workpiece comprises the step of applying the radiant heat from a position wherein the heat is applied to opposing sides of the workpiece, both of which sides are generally perpendicular to a working face-engaging side of the workpiece.

In accordance with another embodiment of the invention, the step of passing the electrical current to the workpiece comprises the step of passing the electrical current to the workpiece through the jaws.

In accordance with another embodiment of the invention, the method includes the steps of determining the optimum temperature of the workpiece, sensing the actual temperature of the workpiece, and applying radiant heat to the workpiece sufficient to raise the actual temperature of the workpiece to the optimum temperature of the workpiece.

In accordance with another embodiment of the invention, the method further comprises the step of correlating the distance from the portion of the workpiece to be radiantly heated with the radiant energy being applied to the workpiece.

In accordance with another embodiment of the invention, the method includes the step of creep-forming of the workpiece by maintaining the workpiece formed against the working face and at the working temperature for a selected dwell time.

In accordance with another embodiment of the invention, the method includes the step of surrounding the die and a first portion of the workpiece with an enclosure having walls on which radiant heating elements are mounted for supplying the radiant heat.

In accordance with another embodiment of the invention, the enclosure includes an opening for allowing end portions of the workpiece to protrude from the enclosure while the forming step takes place within the enclosure.

In accordance with another embodiment of the invention, a stretch-forming apparatus is provided, including a die having a working face with a profile adapted to receive and form an elongated metallic workpiece, wherein at least the working face comprises a thermally insulated material. A resistance heater is provided for electric resistance heating the workpiece to a working temperature, and movement elements engage the workpiece for moving the die and a workpiece relative to each other to elongate and bend workpiece against the working face. A radiant heater is provided for applying radiant heat to one or more predetermined portions of the workpiece to increase the plastic elongation of the workpiece at the one or more predetermined portions.

In accordance with another embodiment of the invention, the workpiece comprises titanium, and the radiant heater is located to apply the radiant heat from a position wherein the heat is applied to a side of the workpiece opposite a working face-engaging side of the workpiece.

In accordance with another embodiment of the invention, the radiant heater is located to apply the radiant heat to a side of the workpiece generally perpendicular to a working face-engaging side of the workpiece.

In accordance with another embodiment of the invention, the radiant heater is located to apply the radiant heat to opposing sides of the workpiece, both of which sides are generally perpendicular to a working face-engaging side of the workpiece.

In accordance with another embodiment of the invention, the apparatus includes an enclosure surrounding the die and having interior walls on which radiant heating elements are mounted for supplying the radiant heat.

In accordance with another embodiment of the invention, the enclosure includes a door for gaining access to the die, and a floor and a roof, the door, floor and roof each having at least one respective radiant heating element mounted thereon for applying radiant heat to the workpiece.

In accordance with another embodiment of the invention, wherein the door, floor and roof each define separate heating zones, and each heating zone includes at least one radiant heater adapted for supplying the radiant heat at a predetermined rate independent from the other heating zones in response to a predetermined temperature input criteria.

In accordance with another embodiment of the invention, at least one thermocouple is provided for being releasably attached to the workpiece and communicating with a temperature control circuit for determining any variance between an actual and optimum workpiece temperature.

In accordance with another embodiment of the invention, at least one infrared temperature detector is positioned in optical communication to the workpiece and communicates with a temperature control circuit for determining any variance between an actual and optimum workpiece temperature.

In accordance with another embodiment of the invention, the door includes at least one port, and in infrared temperature detector mounted for optically viewing the workpiece through the port and communicating with a temperature control circuit for determining any variance between an actual and optimum workpiece temperature.

In accordance with another embodiment of the invention, a stretch-forming apparatus is provided, comprising a die having a working face adapted to receive and form an elongated metallic workpiece, wherein at least the working face comprises a thermally insulated material. A heater is provided for electric resistance heating the workpiece to a working temperature. An enclosure is provided for surrounding the die and a first portion of the elongated workpiece during a forming operation, and for permitting a second portion of the workpiece to protrude therefrom. Opposed swing arms are provided to which opposing ends of the workpiece are mounted for moving the die and a workpiece relative to each other so as to cause elongation and bending of the workpiece against the working face. A radiant heater is provided for applying the radiant heat from a position wherein the heat is applied to a side of the workpiece opposite a working face-engaging side of the workpiece. Another radiant heater is located to apply the radiant heat to a side of the workpiece generally perpendicular to a working face-engaging side of the workpiece. Temperature sensors selected from the group consisting of infrared temperature sensors and thermocouple temperature sensors communicate with a temperature control circuit for determining any variance between an actual and optimum workpiece temperature. A servo-feedback loop circuit is provided for applying radiant heat to the workpiece wherein the optimum temperature of the workpiece, the actual temperature of the workpiece and the distance of the workpiece from the radiant heater are correlated and sufficient heat is supplied to the workpiece from the radiant heater to maintain the temperature of the workpiece at the optimum temperature without regard to the distance between the workpiece and the radiant heater.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
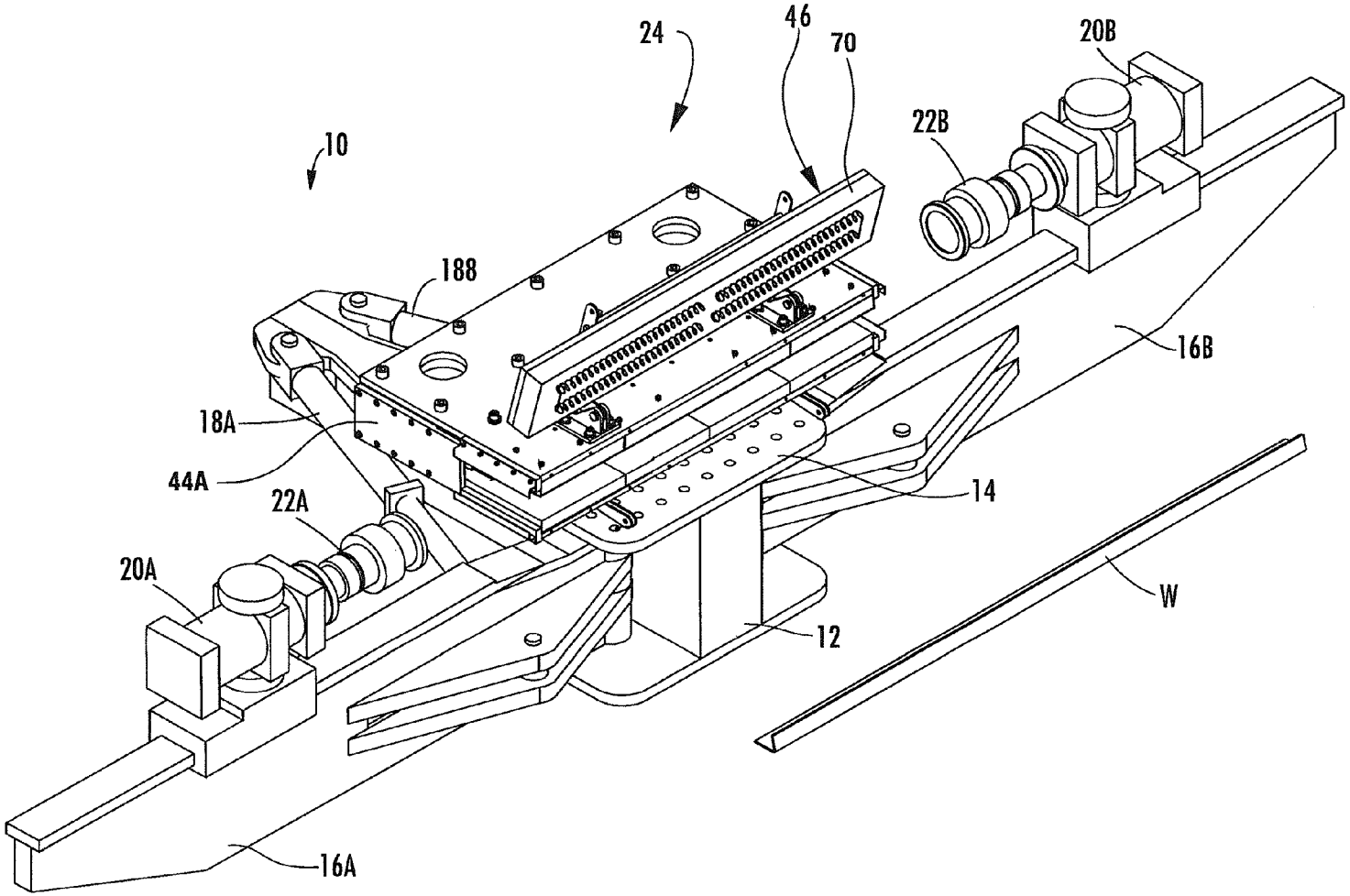
FIG. 1 is a perspective view of an exemplary stretch-forming apparatus constructed in accordance with the present invention.
Figure 10:
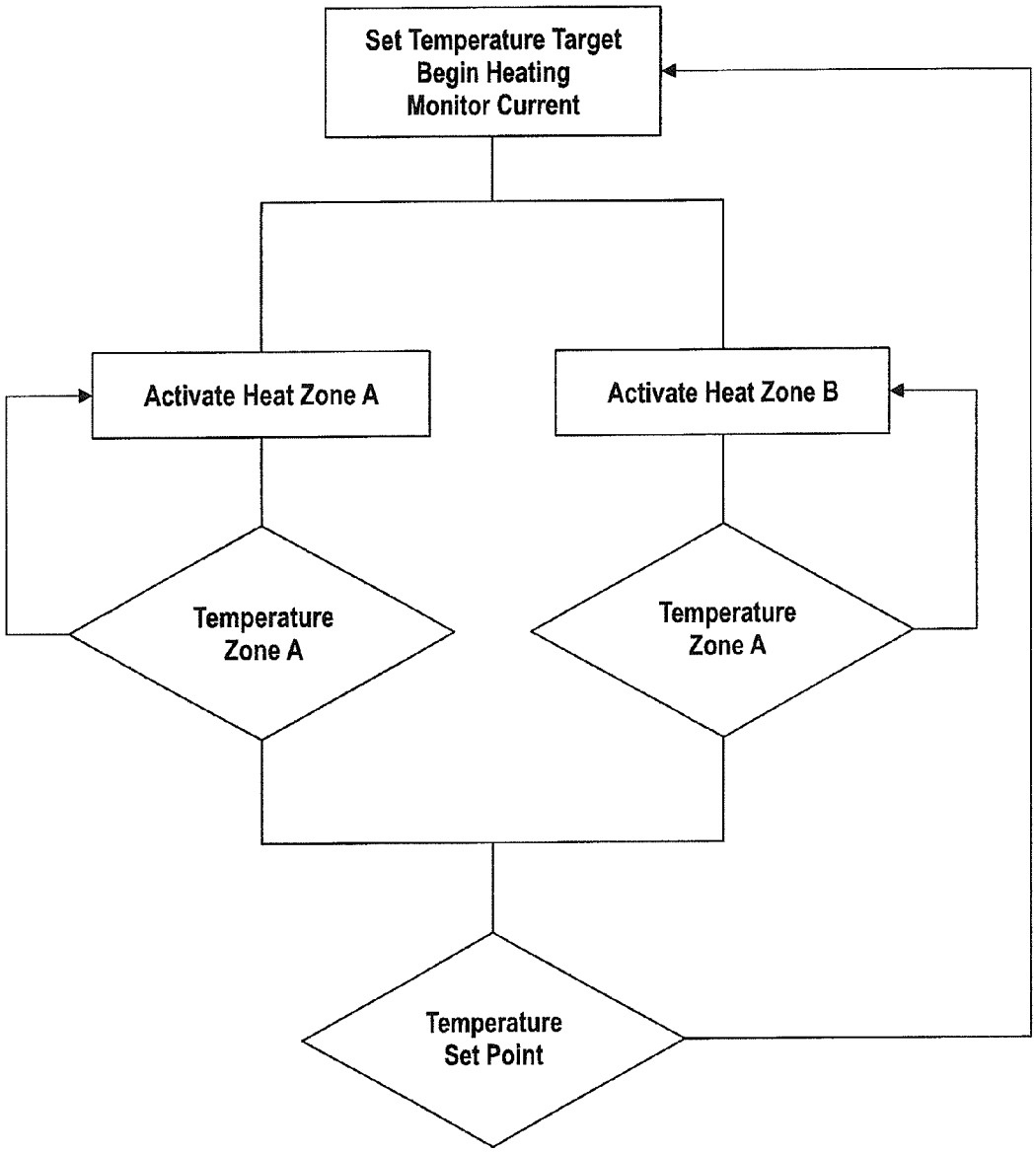
FIG. 10 is a block diagram illustrating an exemplary process flow diagram of the heating control/temperature feedback monitoring function of the forming method.

Referring to the drawings wherein identical reference numerals denote the same elements throughout the various views, FIG. 1 illustrates an exemplary stretch-forming apparatus 10 constructed in accordance with the present invention, along with an exemplary workpiece "W." As shown in FIG. 10, the exemplary workpiece "W" is an extrusion with an L-shaped cross-sectional profile. Any desired shape may be stretch-formed in accordance with the invention.

The present invention is suitable for use with various types of workpieces, including but not limited to rolled flats or rolled shapes, bar stock, press-brake formed profiles, extruded profiles, machined profiles, and the like. The present invention is especially useful for workpieces having non-rectangular cross-sectional profiles, and for workpieces having cross-sectional profiles with aspect ratios of about 20 or less. As shown in FIG. 10, the aspect ratio is the ratio of the lengths "L1" and "L2" of a rectangular box "B" surrounding the outer extents of the cross-sectional profile. Of course, the cross-sectional shape and aspect ratio are not intended to be limiting, and are provided by way of example only.

The apparatus 10 includes a substantially rigid main frame 12 which defines a die mounting surface 14 and supports the main operating components of the apparatus 10. First and second opposed swing arms 16A and 16B are pivotally mounted to the main frame 12 and are coupled to hydraulic forming cylinders 18A and 18B, respectively. The swing arms 16A and 16B carry hydraulic tension cylinders 20A and 20B which in turn have hydraulically operable jaw assemblies 22A and 22B mounted thereto. The tension cylinders 20 may be attached to the swing arms 16 in a fixed orientation, or they may be pivotable relative to the swing arms 16 about a vertical axis. A die enclosure 24, described in more detail below, is mounted to the die mounting surface 14 between the jaw assemblies 22A and 22B.

Appropriate pumps, valving, and control components (not shown) are provided for supplying pressurized hydraulic fluid to the forming cylinders 18, tension cylinders 20, and jaw assemblies 22. Alternatively, the hydraulic components described above could be replaced with other types of actuators, such as electric or electromechanical devices. Control and sequencing of the apparatus 10 may be manual or automatic, for example, by PLC or PC-type computer.

The principles of the present invention are equally suitable for use with all types of stretch formers, in which a workpiece and a die move relative to each other to creating a forming action. Known types of such formers may have fixed or moving dies and may be horizontally or vertically oriented.

Figure 2:
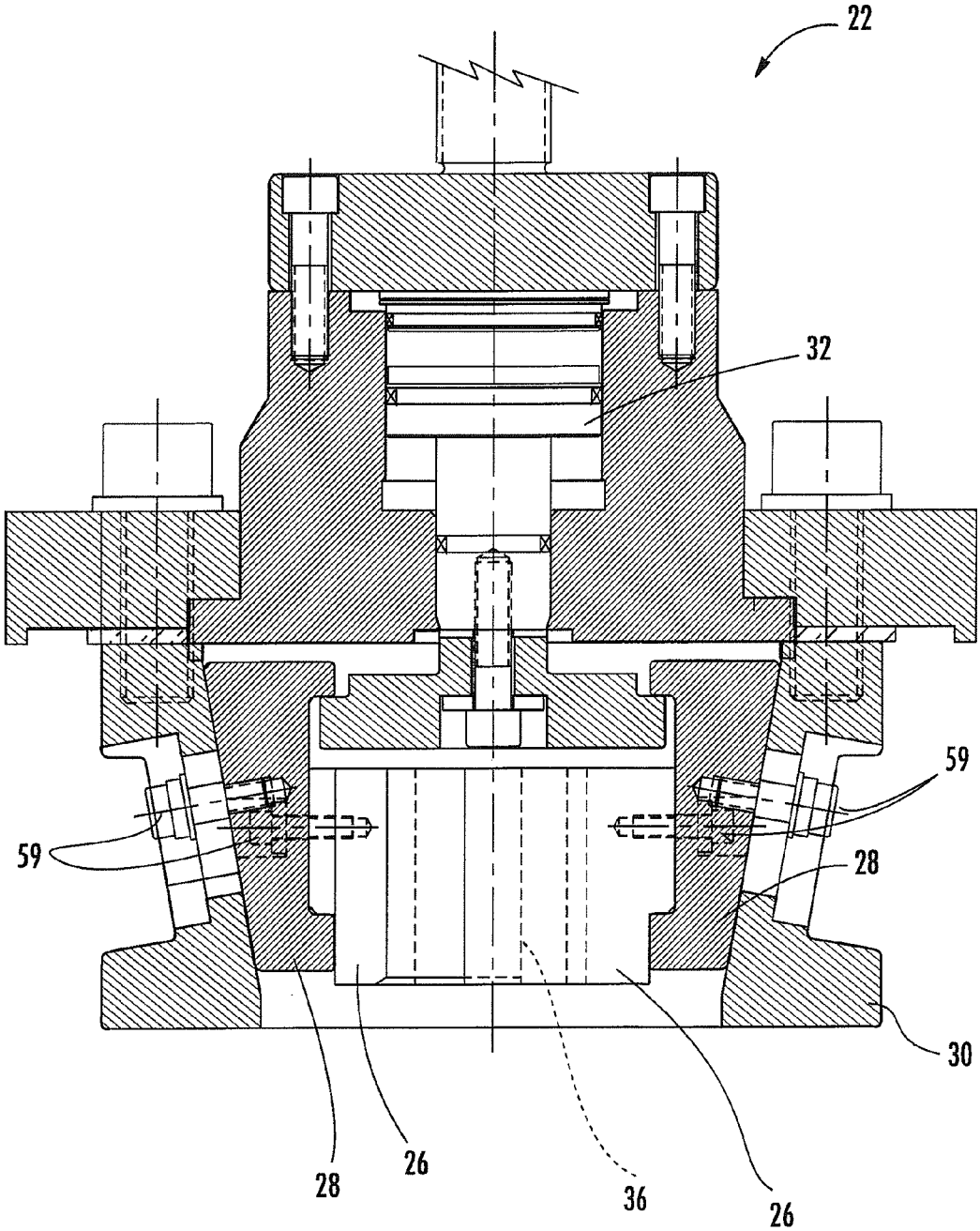
FIG. 2 is a top sectional view of a jaw assembly of the stretch-forming apparatus of FIG. 1.

FIG. 2 illustrates the construction of the jaw assembly 22A, which is representative of the other jaw assembly 22B. The jaw assembly 22A includes spaced-apart jaws 26 adapted to grip an end of a workpiece "W" and mounted between wedge-shaped collets 28, which are themselves disposed inside an annular frame 30. A hydraulic cylinder 32 is arranged to apply an axial force on the jaws 26 and collets 28, causing the collets 28 to clamp the jaws 26 tightly against the workpiece "W." The jaw assembly 22A, or the majority thereof, is electrically insulated from the workpiece "W." This may be accomplished by applying an insulating layer or coating, such as an oxide-type coating, to the jaws 26, collets 28, or both. If a coating 34 is applied all over the jaws 26 including the faces 36 thereof, then the jaw assembly 22A will be completely isolated. If it is desired to apply heating current through the jaws 26, then their faces 36 would be left bare and they would be provided with appropriate electrical connections. Alternatively, the jaws 26 or collets 28 could be constructed from an insulated material as described below with respect to the die 58, such as a ceramic material. The jaws 26 and collets 28 may be installed using insulating fasteners 59 to avoid any electrical or thermal leakage paths to the remainder of the jaw assembly 22A.

Figure 3:
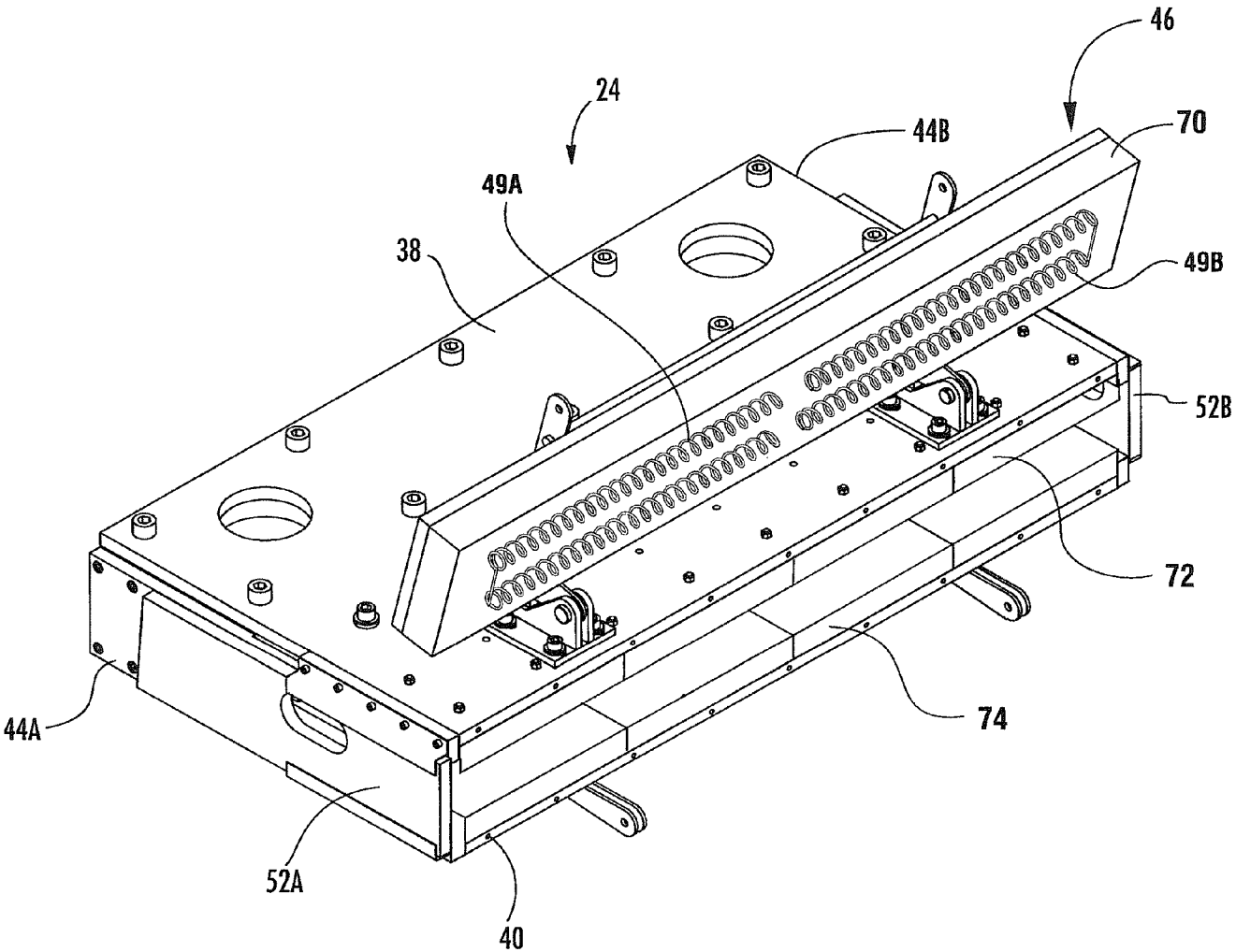
FIG. 3 is a perspective view of a die enclosure which forms part of the apparatus shown in FIG. 1, with a door thereof in an open position.
Figure 4:
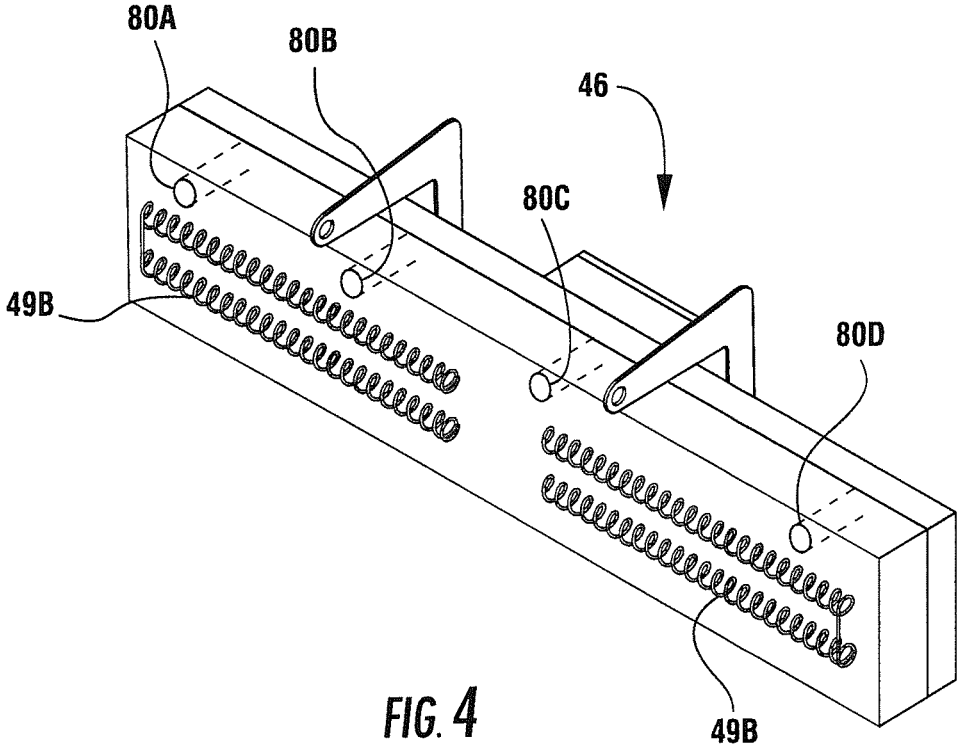
FIG. 4 is a cross-sectional view of the die enclosure shown in FIG. 3, showing the internal construction thereof.
Figure 5:
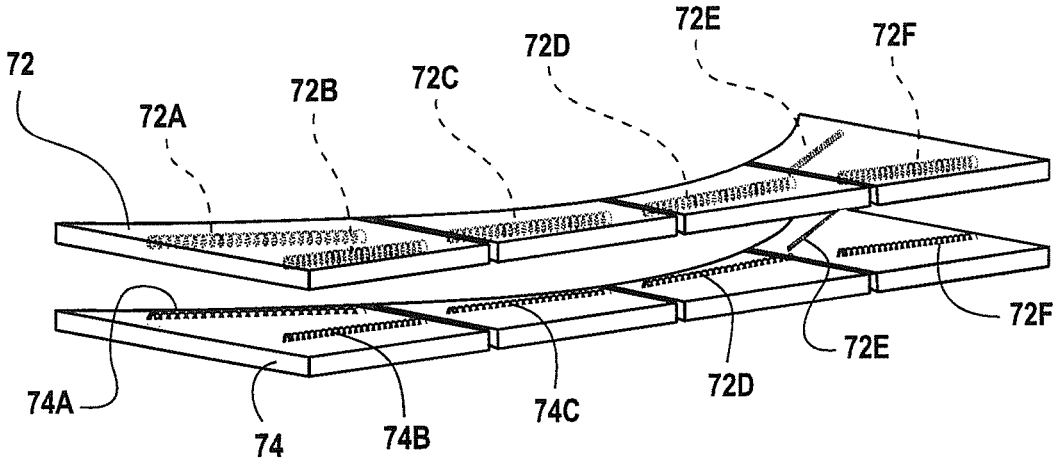
FIG. 5 is a top plan view of the die enclosure of FIG. 3.
Figure 7:
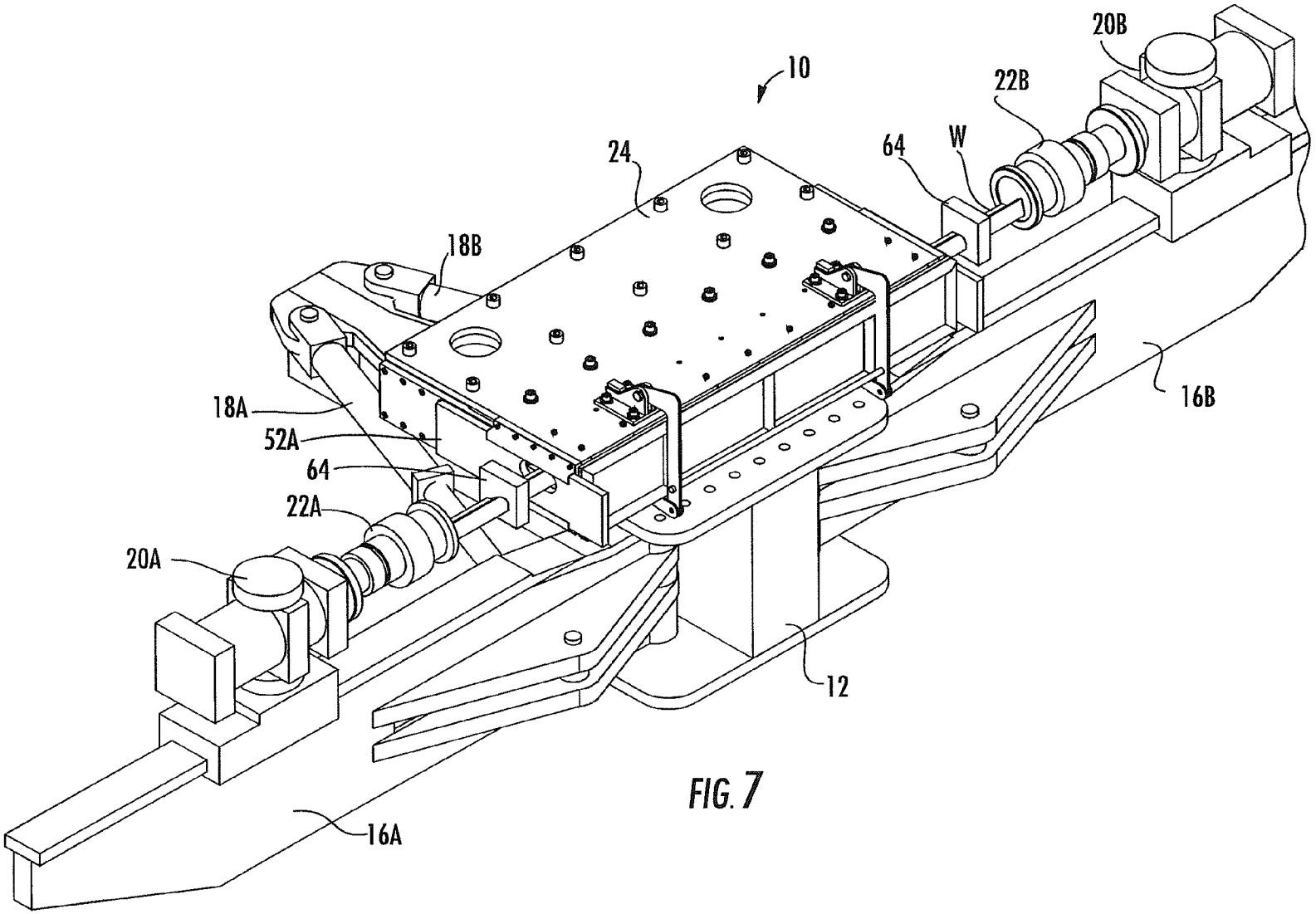
FIG. 7 is a perspective view of the stretch-forming apparatus shown in FIG. 1 with a workpiece loaded therein and ready to be formed.
Figure 8:
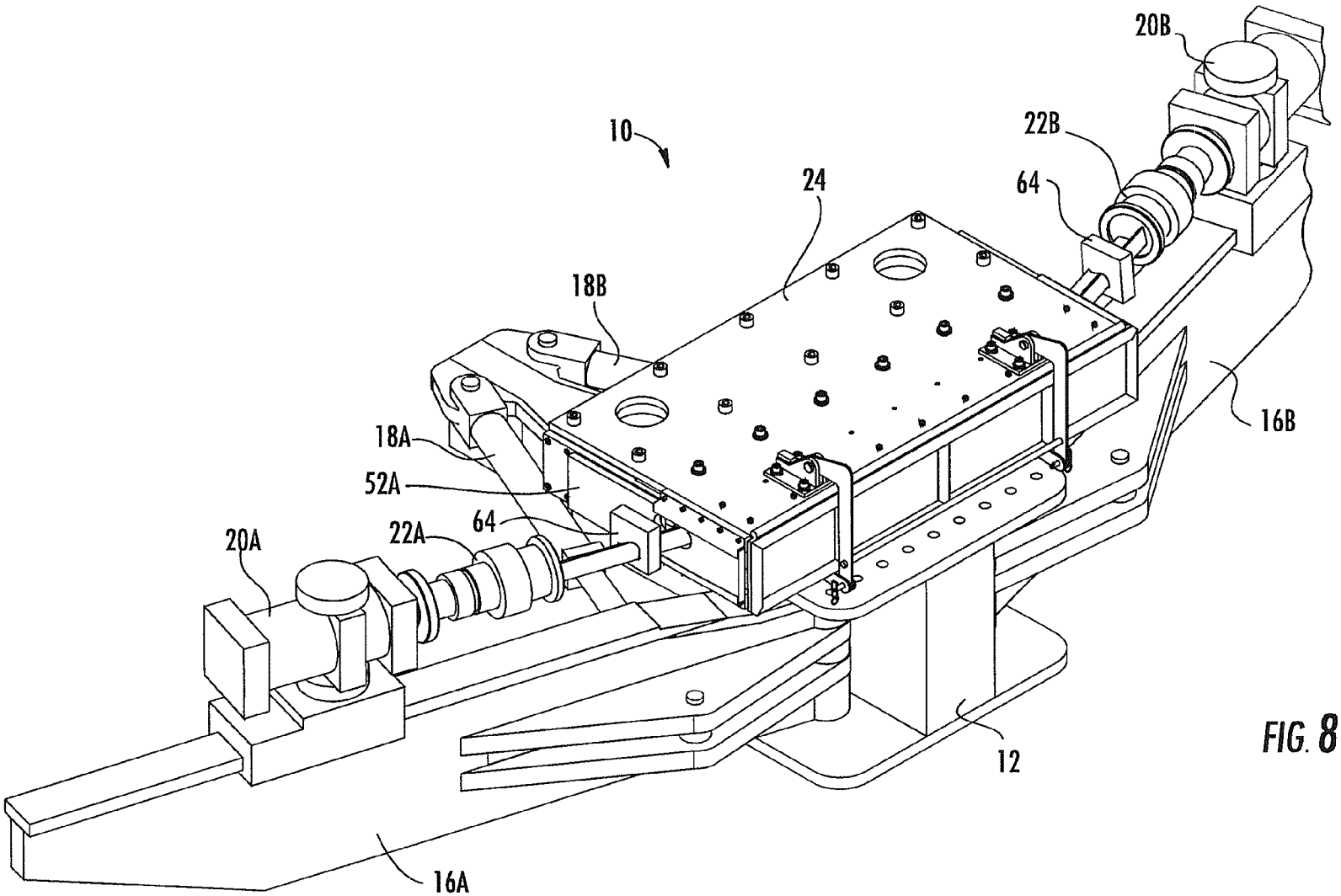
FIG. 8 is another perspective view of the stretch-forming apparatus with a workpiece fully formed.

Referring now also to FIGS. 3-5, the die enclosure 24 is a box-like structure having top and bottom walls 38 and 40, a rear wall 42, side walls 44A and 44B, and a front door 46 which can swing from an open position, shown in FIGS. 1 and 3, to a closed position shown in FIGS. 7 and 8. The specific shape and dimensions will, of course, vary depending upon the size and proportions of the workpieces to be formed. The die enclosure 24 is fabricated from a material such as steel, and is generally constructed to minimize air leakage and thermal radiation from the workpiece "W." The die enclosure 24 may be thermally insulated, if desired.

A die 58 is disposed inside the die enclosure 24. The die 58 is a relatively massive body with a working face 60 that is shaped so that a selected curve or profile is imparted to the workpiece "W" as it is bent around the die 58. The cross-section of the working face 60 generally conforms to the cross-sectional shape of the workpiece "W," and may include a recess 62 to accommodate protruding portions of the workpiece "W" such as flanges or rails. If desired, the die 58 or a portion thereof may be heated. For example, the working face 62 of the die 58 may be made from a layer of steel or another thermally conductive material which can be adapted to electric resistance heating.

As is best shown in FIGS. 3 and 4, the door 46 includes resistance coils 49A, 49B. The coils 49A, 49B are partially embedded in an interior insulating layer 70, such as a ceramic material and, when the door is closed and the stretch-forming apparatus 10 is in operation, the coils 49A, 49B are resistively heated to a temperature sufficient to project supplemental radiant heat onto the workpiece "W," as described in further detail below.

Referring now to FIGS. 3 and 5, the top and bottom walls 38 and 40 include respective ceramic roof and floor inserts 72, 74 in which are partially embedded sets of resistance coils 72A-72F and 74A-74F. As can be seen, the roof and floor inserts 72, 74 are shaped to reside in the enclosure 24 between the door 46 and the working face 60 of the die 58. For purposes of clarity, the coils 72A-72F in the roof insert 72 are shown in phantom, and face downwardly into the enclosure and radiate heat into the enclosure towards the coils 74A-74F of the floor insert 74.

The coils 72A-72F and 74A-74F are preferably independently controlled to radiate precise and varying amounts of heat so that, in cooperation with the resistance coils in the door 49A, 49B in the door 46, predetermined areas of the workpiece "W" can be heated to a precise temperature independent of the temperature of other areas of the workpiece "W." For example, coils 72A, 72E and 74A, 74E can be brought into operation, or additional current supplied, as the "W" is formed around the die 58 and moves under those coils. Similarly, current flowing to the coils 49A, 49B can be increased as the ends of the workpiece "W" move away from the door 46 during forming in order to project more radiant heat onto and maintain the ends of the workpiece "W" at the desired temperature. These conditions are preferably controlled by a servo-feedback loop and the temperature of the workpiece "W" can be determined on a realtime basis by providing ports 80A-80D in the door 46 through which infrared temperature detectors (not shown) mounted outside the door 46 sense the temperature of the workpiece "W" and transmit that information to the controller. In addition to or alternatively to the infrared detectors, one or more thermocouples can be physically attached to the workpiece "W" at desired locations in order to determine the temperature of the workpiece "W" at those locations. Interpolations or averaging procedures can be used to arrive at a precise temperature profile, and repeatable temperature variations necessary to achieve precisely repeatable workpiece "W" shapes.

Figure 6:
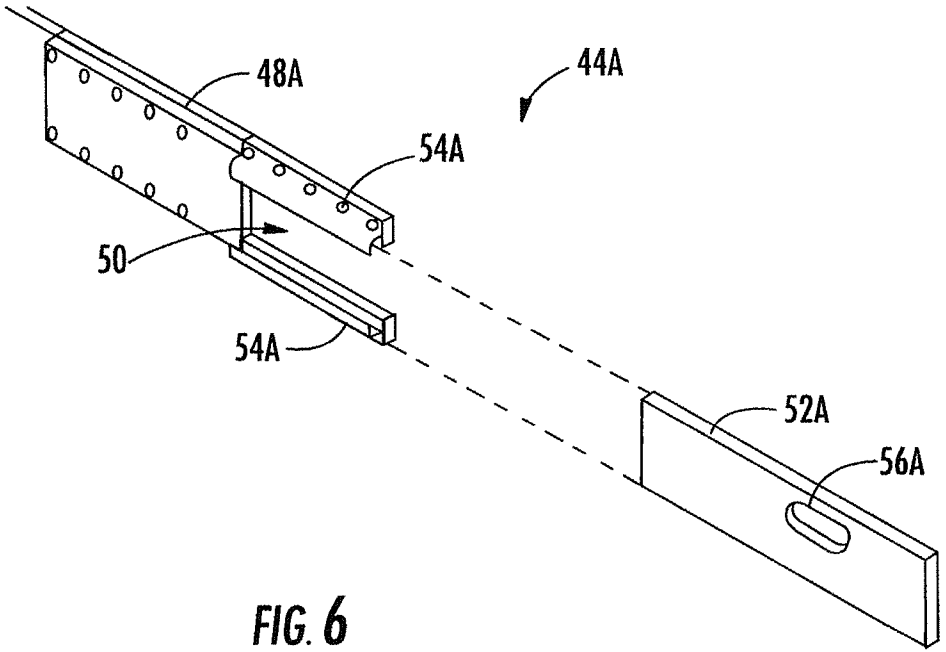
FIG. 6 is an exploded view of a portion of the die enclosure, showing the construction of a side door thereof.

FIG. 6 illustrates one of the side walls 44A, which is representative of the other side wall 44B, in more detail. The side wall 44A comprises a stationary panel 48A which defines a relatively large side opening 50A. A side door 52A is mounted to the stationary panel 48A, for example with Z-brackets 54A, so that it can slide forwards and backwards with the workpiece "W" during a forming process while maintaining close contact with the stationary panel 48A. The side door 52A has a workpiece opening 56A formed therethrough which is substantially smaller than the side opening 50A, and is ideally just large enough to allow a workpiece "W" to pass therethrough. Other structures which are capable of allowing movement of the workpiece ends while minimizing workpiece exposure may be substituted for the side walls 44 without affecting the basic principle of the die enclosure 24.

During the stretch-forming operation, the workpiece "W" will be heated to temperatures of between 480° C. (900° F.) to 700° C. (1300° F.) or greater. Therefore, the die 58 is constructed of a material or combination of materials which are thermally insulated. The key characteristics of these materials are that they resist heating imposed by contact with the workpiece "W," remain dimensionally stable at high temperatures, and minimize heat transfer from the workpiece "W." It is also preferred that the die 58 be an electrical insulator so that resistance heating current from the workpiece "W" will not flow into the die 58. In the illustrated example, the die 58 is constructed from multiple pieces of a ceramic material such as fused silica. The die 58 may also be fabricated from other refractory materials, or from non-insulating materials which are then coated or encased by an insulating layer.

Because the workpiece "W" is electrically isolated from the stretch forming apparatus 10, the workpiece "W" can be heated using electrical resistance heating. A connector 64 (see FIG. 7) from a current source may be placed on each end of the workpiece "W." Alternatively, the heating current connection may be directly through the jaws 26, as described above. By using the thermocouples or infrared detectors, the current source can be PLC controlled using a temperature feedback signal. This will allow proper ramp rates for rapid but uniform heating, as well as allow for the retardation of current once the workpiece "W" reaches the target temperature. A PID control loop of a known type can be provided to allow for adjustments to be automatically made as the workpiece temperature varies during the forming cycle. This control may be active and programmable during the forming cycle.

Figure 9A:
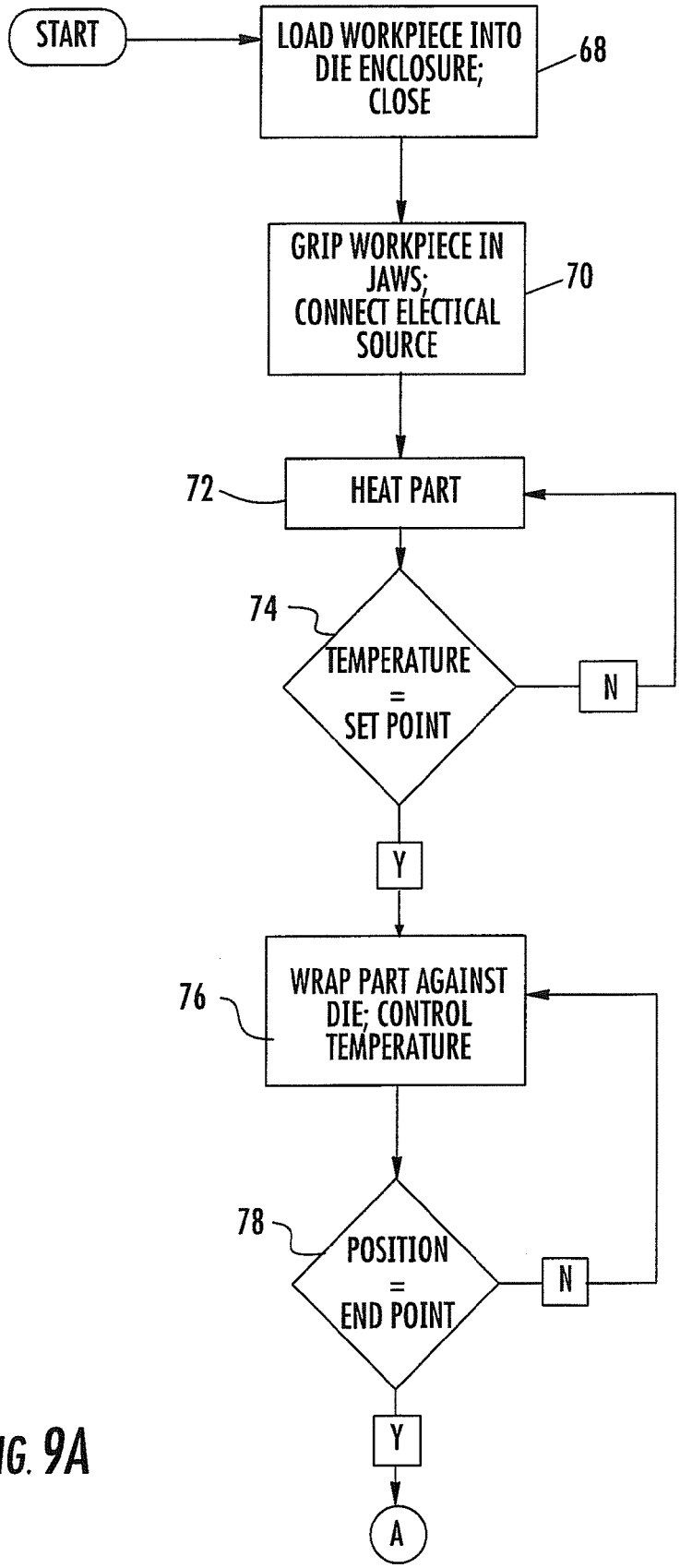
FIG. 9A is a block diagram illustrating an exemplary forming method using the stretch-forming apparatus.
Figure 9B:
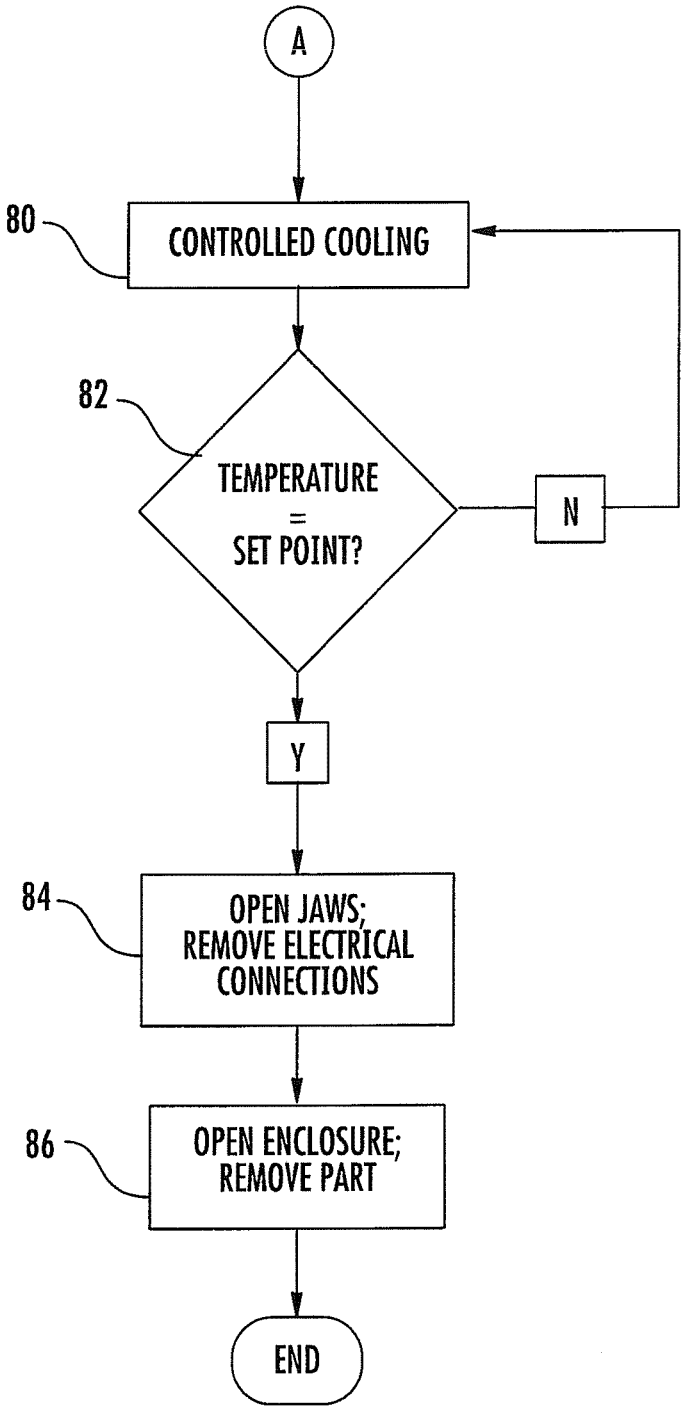
FIG. 9B is a continuation of the block diagram of FIG. 9A.

An exemplary forming process using the stretch forming apparatus 10 is described with reference to FIGS. 7 and 8, and the block diagram contained in FIGS. 9A and 9B. First, at block 68, workpiece "W" is loaded into the die enclosure 24, with its ends protruding from the workpiece openings 56, and the front door 46 is closed. The side doors 52 are in their forward-most position. This condition is shown in FIG. 7. As noted above, the process is particularly useful for workpieces "W" which are made from titanium or alloys thereof. However, it may also be used with other materials where hot-forming is desired. Certain workpiece profiles require the use of flexible backing pieces or "snakes" to prevent the workpiece cross section from becoming distorted during the forming cycle. In this application, the snakes used would be made of a high temperature flexible insulating material where practical. If required, the snakes could be made from high temperature heated materials to avoid heat loss from the workpiece "W."

Any connections to thermocouples or additional feedback devices for the control system are connected during this step. Once inside the die enclosure 24, the ends of the workpiece "W" are positioned in the jaws 26 and the jaws 26 are closed, at block 70. If separate electrical heating connections 64 are to be used, they are attached to the workpiece "W," using a thermally and electrically conductive paste as required to achieve good contact.

In the loop illustrated at blocks 72 and 74, current is passed through the workpiece "W," causing resistance heating thereof. Closed loop controlled heating of the workpiece "W" continues utilizing feedback from the thermocouples or other temperature sensors until the desired working temperature set point is reached. The rate of heating of the workpiece to the set point is determined taking into account the workpiece cross-section and length as well as the thermocouple feedback.

Once the working temperature has been reached, the workpiece forming can begin. Until that set point is reached, closed loop heating of the workpiece "W" continues.

In the loop shown at blocks 76 and 78, the tension cylinders 20 stretch the workpiece "W" longitudinally to the desired point, and the main cylinders 18 pivot the swing arms 16 inward to wrap the workpiece "W" against the die 58 while the working temperature is controlled as required. The side doors 52 slide backwards to accommodate motion of the workpiece ends. This condition is illustrated in FIG. 8. The stretch rates, dwell times at various positions, and temperature changes can be controlled via feedback to the control system during the forming process. Once position feedback from the swing arms 16 indicates that the workpiece "W" has arrived at its final position, the control maintains position and/or tension force until the workpiece "W" is ready to be released. Until that set point is reached, the control will continue to heat and form the workpiece "W" around the die. Creep forming may be induced by maintaining the workpiece "W" against the die 58 for a selected dwell time while the temperature is controlled as needed.

In the loop shown in blocks 80 and 82, the workpiece "W" is allowed to cool at a rate slower than natural cooling by adding supplemental heat via the current source. This rate of temperature reduction is programmed and will allow the workpiece "W" to cool while monitoring it via temperature feedback.

Once the temperature has arrived at its final set point, force on the workpiece "W" is released and the flow of current from the current source stops. Until that final set point is reached, the control will maintain closed loop heating sufficient to continue to cool the workpiece "W" at the specified rate.

After the force is removed from the workpiece "W," the jaws 26 may be opened and the electrical clamps removed (block 84). After opening the jaws 26 and removing the electrical connectors 64, the die enclosure 24 may be opened and the workpiece "W" removed. The workpiece "W" is then ready for additional processing steps such as machining, heat treatment, and the like.

The process described above allows the benefits of stretch-forming and creep-forming, including inexpensive tooling and good repeatability, to be achieved with titanium components. This will significantly reduce the time and expense involved compared to other methods of forming titanium parts. Furthermore, isolation of the workpiece from the outside environment encourages uniform heating and minimizes heat loss to the environment, thereby reducing overall energy requirements. In addition, the use of the die enclosure 24 enhances safety by protecting workers from contact with the workpiece "W" during the cycle.

Figure 11:
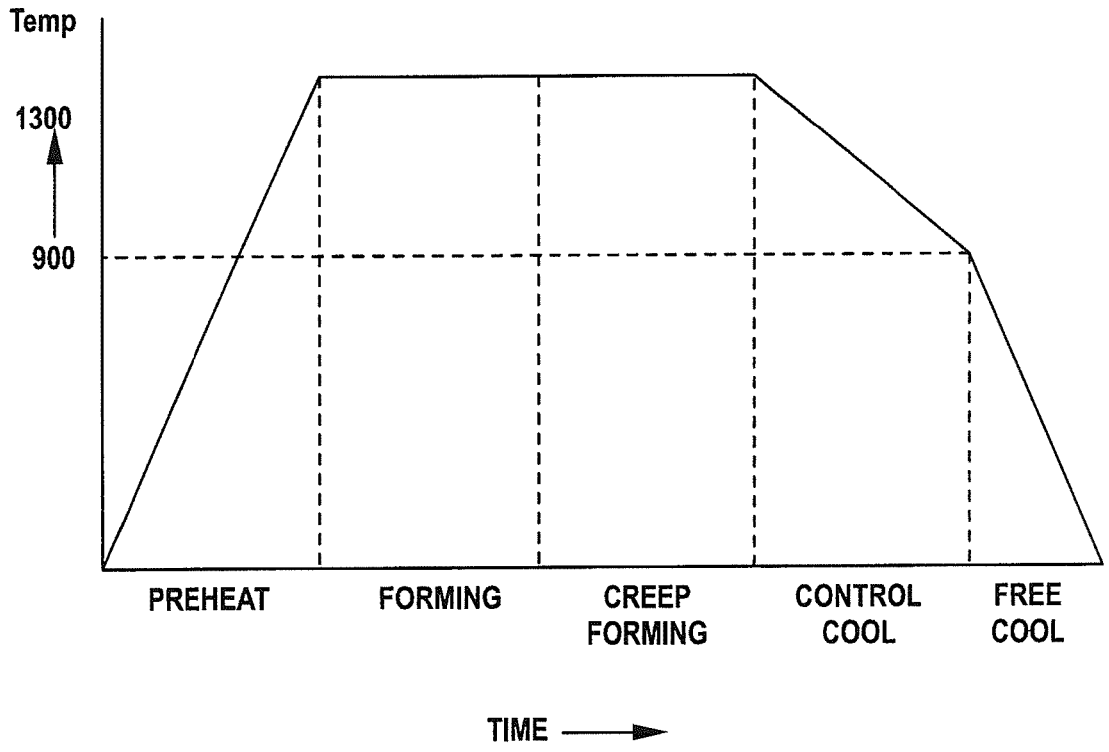
FIG. 11 is a time/temperature graph showing one forming cycle according to one embodiment of the invention.

As is shown graphically in FIG. 11, both forming and creep forming occurs at maximum temperature. In a typical forming process the pre-heating stage can be accomplished in approximately 20 minutes, followed by the primary forming step, which takes on the order of 3 minutes. Creep forming may take on the order of 10 minutes, followed by a controlled cooling step of approximately 1 hour during which step the part is allowed to slowly cool. Cooling to ambient temperature then occurs naturally.

An apparatus and method for stretch-forming of titanium is described above. Various details of the invention may be changed without departing from its scope. Furthermore, the foregoing description of the preferred embodiment of the invention and the best mode for practicing the invention are provided for the purpose of illustration only and not for the purpose of limitation.

We claim:

1. A method of stretch-forming, comprising:

(a) providing an elongated metallic workpiece having a preselected cross-sectional profile;

(b) providing a die having a working face with a profile adapted to receive and form the elongated metallic workpiece, the working face being complementary to the cross-sectional profile, wherein at least the working face comprises a thermally insulated material;

(c) providing a resistance heater for electric resistance heating the workpiece to a working temperature;

(d) providing movement elements engaging the workpiece for moving the die and a workpiece relative to each other to elongate and bend workpiece against the working face;

(e) providing a radiant heater for applying radiant heat to one or more predetermined portions of the workpiece to increase the plastic elongation of the workpiece at the one or more predetermined portions;

(f) resistance heating the workpiece to a working temperature by passing electrical current therethrough;

(g) forming the workpiece against the working face by causing the workpiece and the die to move relative to each other while the workpiece is at the working temperature, thereby causing plastic elongation and bending of the workpiece and shaping the workpiece into a preselected final form; and (h) at one or more predetermined positions of the workpiece in relation to the die, applying radiant heat to one or more predetermined portions of the workpiece to increase the plastic elongation of the workpiece at the one or more predetermined portions.

2. The method of claim 1, wherein the workpiece comprises titanium.

3. The method of claim 1, wherein the step of applying radiant heat to the workpiece comprises the step of applying the radiant heat from a position wherein the heat is applied to a side of the workpiece opposite a working face-engaging side of the workpiece.

4. The method of claim 1, wherein the step of applying radiant heat to the workpiece comprises the step of applying the radiant heat from a position wherein the heat is applied to a side of the workpiece generally perpendicular to a working face-engaging side of the workpiece.

5. The method of claim 1, wherein the step of applying radiant heat to the workpiece comprises the step of applying the radiant heat from a position wherein the heat is applied to opposing sides of the workpiece, both of which sides are generally perpendicular to a working face-engaging side of the workpiece.

6. The method of claim 1, wherein the step of passing the electrical current to the workpiece comprises the step of passing the electrical current to the workpiece through the jaws.

7. The method of claim 1, and including the steps of determining the optimum temperature of the workpiece, sensing the actual temperature of the workpiece, and applying radiant heat to the workpiece sufficient to raise the actual temperature of the workpiece to the optimum temperature of the workpiece.

8. The method of claim 7, and further comprising the step of correlating the distance from the portion of the workpiece to be radiantly heated with the radiant energy being applied to the workpiece.

9. The method of claim 1, and further comprising the step of creep-forming of the workpiece by maintaining the workpiece formed against the working face and at the working temperature for a selected dwell time.

10. The method of claim 1, and further comprising the step of surrounding the die and a first portion of the workpiece with an enclosure having walls on which radiant heating elements are mounted for supplying the radiant heat.

11. The method of claim 10, wherein the enclosure includes an opening for allowing end portions of the workpiece to protrude from the enclosure while the forming step takes place.

12. The method of claim 1, wherein the working face of the die is heated.

13. A stretch-forming apparatus, comprising:

(a) a die having a working face with a profile adapted to receive and form an elongated metallic workpiece, wherein at least the working face comprises a thermally insulated material;

(b) a resistance heater for electric resistance heating the workpiece to a working temperature;

(c) movement elements engaging the workpiece for moving the die and a workpiece relative to each other to elongate and bend workpiece against the working face; and (d) a radiant heater for applying radiant heat to one or more predetermined portions of the workpiece to increase the plastic elongation of the workpiece at the one or more predetermined portions.

14. The stretch-forming apparatus of claim 13, wherein the workpiece comprises titanium.

15. The stretch-forming apparatus of claim 13, wherein the radiant heater is located to apply the radiant heat from a position wherein the heat is applied to a side of the workpiece opposite a working face-engaging side of the workpiece.

16. The stretch-forming apparatus of claim 13, wherein the radiant heater is located to apply the radiant heat to a side of the workpiece generally perpendicular to a working face-engaging side of the workpiece.

17. The stretch-forming apparatus of claim 13, wherein the radiant heater is located to apply the radiant heat to opposing sides of the workpiece, both of which sides are generally perpendicular to a working face-engaging side of the workpiece.

18. The stretch-forming apparatus of claim 17, and including an enclosure surrounding the die and having interior walls on which radiant heating elements are mounted for supplying the radiant heat.

19. The stretch-forming apparatus of claim 13, wherein the enclosure includes a door for gaining access to the die, and a floor and a roof, the door, floor and roof each having at least one respective radiant heating element mounted thereon for applying radiant heat to the workpiece.

20. The stretch-forming apparatus of claim 19, wherein the door, floor and roof each define separate heating zones, and each heating zone includes at least one radiant heater adapted for supplying the radiant heat at a predetermined rate independent from the other heating zones in response to a predetermined temperature input criteria.

21. The stretch-forming apparatus of claim 13, and including at least one thermocouple releasably attached to the workpiece and communicating with a temperature control circuit for determining any variance between an actual and optimum workpiece temperature.

22. The stretch-forming apparatus of claim 13, and including at least one infrared temperature detector positioned in optical communication to the workpiece and communicating with a temperature control circuit for determining any variance between an actual and optimum workpiece temperature.

23. The stretch-forming apparatus of claim 19, wherein the door includes at least one port, and an infrared temperature detector mounted for optically viewing the workpiece through the at least one port and communicating with a temperature control circuit for determining any variance between an actual and optimum workpiece temperature.

24. A stretch-forming apparatus, comprising:

(a) a die having a working face with a profile adapted to receive and form an elongated metallic workpiece, wherein at least the working face comprises a thermally insulated material;

(b) a resistance heater for electric resistance heating the workpiece to a working temperature;

(c) an enclosure for surrounding the die and a first portion of the elongated workpiece during a forming operation, and for permitting a second portion of the workpiece to protrude therefrom;

(d) opposed swing arms to which opposing ends of the workpiece are mounted for moving the die and a workpiece relative to each other so as to cause elongation and bending of the workpiece against the working face;

(e) a radiant heater located to apply radiant heat from a position wherein the heat is applied to a side of the workpiece opposite a working face-engaging side of the workpiece to increase the plastic elongation of the workpiece at the side of the workpiece opposite the working face-engaging side of the workpiece;

(f) a radiant heater located to apply radiant heat to a side of the workpiece generally perpendicular to a working face-engaging side of the workpiece to increase the plastic elongation of the workpiece at the side of the workpiece generally perpendicular to the working face-engaging side of the workpiece;

(g) temperature sensors selected from the group consisting of infrared temperature sensors and thermocouple temperature sensors communicating with a temperature control circuit for determining any variance between an actual and optimum workpiece temperature; and (h) a servo-feedback loop circuit for applying radiant heat to the workpiece wherein the optimum temperature of the workpiece, the actual temperature of the workpiece and the distance of the workpiece from the radiant heater is correlated and sufficient heat is supplied to the workpiece from the radiant heater to maintain the temperature of the workpiece at the optimum temperature without regard to the distance between the workpiece and the radiant heater.

* * * * *